US006948279B1

(12) United States Patent
Newton et al.

(10) Patent No.: US 6,948,279 B1
(45) Date of Patent: Sep. 27, 2005

(54) SUPPORT SYSTEM FOR LATERALLY REMOVABLE SASH

(75) Inventors: William P. Newton, Spencerport, NY (US); Robert M. Lucci, Rochester, NY (US); Thomas F. Batten, Webster, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 08/839,161

(22) Filed: Apr. 22, 1997

(51) Int. Cl.[7] ..... E05F 1/16
(52) U.S. Cl. ..... 49/446; 49/453
(58) Field of Search ..... 49/176, 177, 178, 49/179, 180, 181, 182, 183, 184, 185, 186, 49/187, 188, 194, 446, 453, 429, 430; 16/193, 16/197

(56) References Cited

U.S. PATENT DOCUMENTS

| | | | | | |
|---|---|---|---|---|---|
| 569,146 | A | * | 10/1896 | Barney | 49/180 |
| 660,438 | A | * | 10/1900 | Holly | 49/186 |
| 1,932,906 | A | * | 10/1933 | Muir et al. | 49/181 |
| 2,217,543 | A | * | 10/1940 | Gaines et al. | 49/430 |
| 2,791,795 | A | * | 5/1957 | Haas | 49/181 |
| 2,796,630 | A | * | 6/1957 | Haas | 49/446 |
| 2,987,758 | A | * | 6/1961 | Osten, Sr. | 49/446 |
| 3,183,559 | A | * | 5/1965 | Love | 49/430 |
| 3,197,819 | A | * | 8/1965 | Trout | 16/193 |
| 3,206,795 | A | * | 9/1965 | Weidner | 16/193 |
| 3,271,812 | A | | 9/1966 | Skolnik | |
| 3,280,511 | A | * | 10/1966 | Johnson | 16/197 |
| 3,407,434 | A | * | 10/1968 | Scott | 16/197 |
| 3,434,236 | A | * | 3/1969 | Weidner et al. | 49/176 |
| 3,441,978 | A | * | 5/1969 | Perry | 16/193 |
| 4,245,436 | A | | 1/1981 | Riegelman et al. | |
| 4,800,680 | A | | 1/1989 | Westfall et al. | |
| 4,885,871 | A | * | 12/1989 | Westfall et al. | 49/446 |
| 5,189,838 | A | * | 3/1993 | Westfall | 49/181 |
| 5,231,795 | A | | 8/1993 | Westfall | |
| 5,542,212 | A | * | 8/1996 | Erickson et al. | 49/176 |
| 5,572,828 | A | | 11/1996 | Westfall | |

FOREIGN PATENT DOCUMENTS

| | | |
|---|---|---|
| DE | 2046109 | 1/1973 |
| EP | 0509943 | 10/1992 |
| FR | 2718486 | 10/1995 |
| GB | 0729287 | 5/1955 |
| GB | 1002338 | 8/1965 |

* cited by examiner

*Primary Examiner*—Gregory J. Strimbu
(74) *Attorney, Agent, or Firm*—Brown & Michaels, PC

(57) ABSTRACT

A support system for a heavy sash that is laterally removable from between opposed window jambs includes a pair of sash support arms pivotally mounted on each sash stile and counterbalance shoes that engage the support arms to uphold the sash. The support arms, in inwardly dependent positions, can engage the shoes as the sash is lowered onto the shoes; and the support arms, in outwardly extending positions, support the weight of the sash on the shoes. Hooks dependent from the shoes can lock the shoes to the jambs during sash removal or replacement; and the sash support arms, the shoes, and the hooks are all preferably cut from metal extrusions.

45 Claims, 7 Drawing Sheets

SUPPORT SYSTEM FOR LATERALLY REMOVABLE SASH

TECHNICAL FIELD

Support and counterbalancing of heavy sash that are laterally removable from between opposed jambs of a window.

BACKGROUND

This invention improves upon a solution proposed in U.S. Pat. No. 5,231,795 for supporting and counterbalancing a heavy sash that is laterally removable from between opposed jambs of a window. The sash counterbalancing and removal problem is the same one addressed in the '795 patent, but the new solution of this invention offers improved performance.

Large and heavy window sash, such as used in schools, offices, and institutional buildings, move vertically between opposed pairs of jambs that are generally extruded of metal. A sash for such a window can weigh over 100 pounds so that a counterbalance system for shoes supporting such a sash must exert a corresponding upward lift. Locking the support shoes of the counterbalance system within the jambs must be secure and reliable, because of the large spring forces involved. Also, the sash support must make a heavy sash easy to raise and lower, and removal and replacement of a sash must be convenient and reliable. Since such windows are often used in schools, the counterbalance support system must also be tamper resistant to the manipulations of curious children. Besides these requirements, an effective window system must accomplish all the necessary functions in a reliable way with elements that are inexpensive to manufacture and maintain.

SUMMARY OF THE INVENTION

Our support system for a sash that is laterally removable from between opposed window jambs uses sash support arms that are movably arranged for transferring the weight of the sash to the shoes and for bridging distances between the sash stiles and the shoes. When not supporting the weight of the sash, the support arms move to positions that allow the sash to be lifted off of counterbalance support shoes and laterally removed from between the window jambs and conversely reinserted between window jambs and lowered onto the shoes. This is done while the shoes are locked in positions within the window jambs. When the support arms support the weight of the sash, they are in positions that rest the sash weight on the counterbalance shoes to support the weight of the sash.

The counterbalance shoes, which are biased upwardly by counterbalance springs, cooperate with the sash support arms. The shoes receive and support the sash weight transferred to the shoes by the sash support arms, and the shoes have hooks that can be deployed to lock the shoes reliably in the jambs by engaging projections formed in the jambs for this purpose. The hooks are latched in undeployed positions and can be unlatched to engage the jambs' projections and lock the shoes against upward movement.

Several components of the inventive sash support system are preferably formed of metal extrusions. These include the shoes, the sash support arms, and the locking hooks for the shoes. Extrusions for these elements are formed in predetermined cross-sectional configurations or profiles and are cut to suitable widths to perform the necessary cooperative functions.

Forming sash support elements of extruded metal lowers the cost of the system while also providing the strength necessary for supporting a heavy sash. Extruded metal elements also accommodate the configurations necessary for the interactions between the shoes and the sash support arms. Altogether, the improvements of this invention allow easier raising and lowering of the sash, more convenient sash removal and replacement, and a more convenient way of locking the shoes in place. They also allow all this to be accomplished with a system that is less costly to manufacture and maintain.

DRAWINGS

FIGS. 1–3 schematically illustrate the removal and replacement of a sash supported by the inventive system with the sash moved laterally for removal or insertion in FIG. 1, lifted above or lowered onto counterbalance shoes in FIG. 2, and supported on counterbalance shoes in FIG. 3.

DETAILED DESCRIPTION

A sash supported according to this invention is laterally removable from between a pair of opposed window jambs in a way that is similar to the sash removal shown in U.S. Pat. No. 5,231,795. Otherwise, the improved sash support system, including sash support arms, sash shoes, and shoe-locking hooks, differs significantly from the '795 patent.

Figure 1:
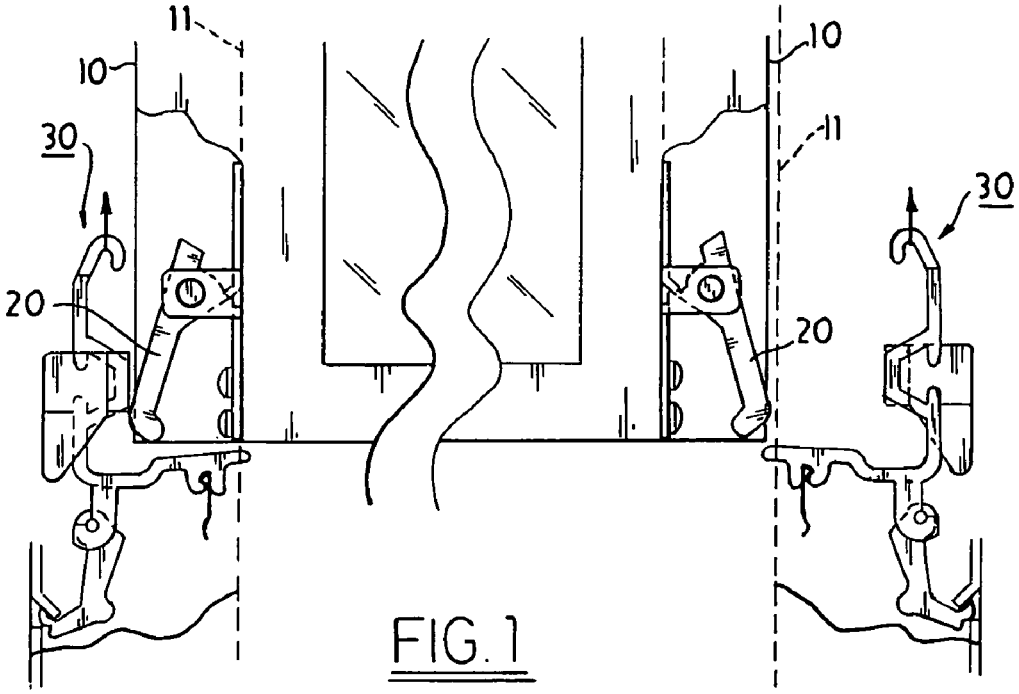
Figure 2:
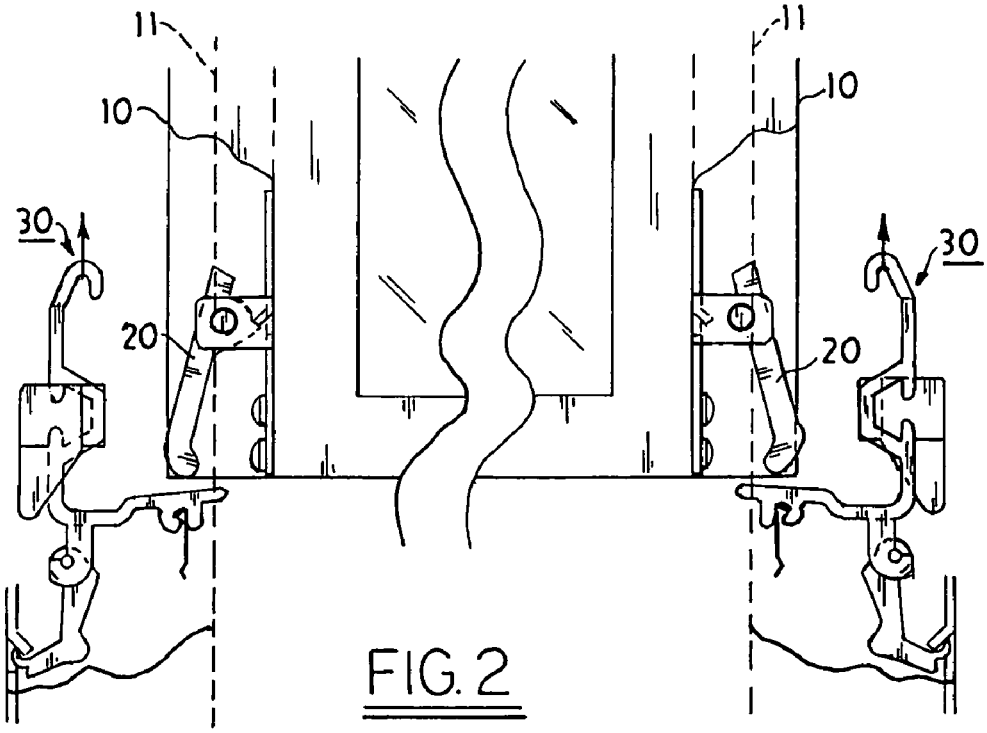
Figure 3:
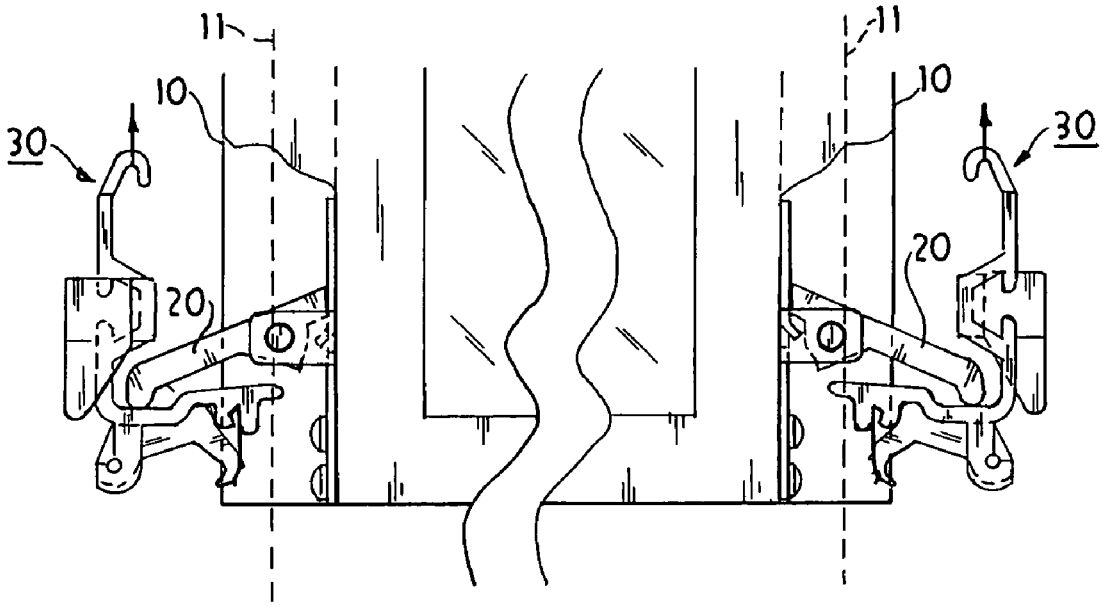

The basic operation of a preferred embodiment of the inventive system is shown schematically in FIGS. 1–3. Sash 10, as shown in FIG. 1, is lifted off of shoes 30 that are locked in place within jambs 11, which are illustrated by broken lines extending along the light opening between jambs 11. For heavy sash that benefit from the inventive support system, jambs 11 are generally extruded of metal to allow lateral room for maneuvering sash 10 in between and out from between jambs 11. Jambs 11 are essentially the same as jambs used with the sash support system of the '795 patent, and such jambs are available in different dimensions to accommodate different sizes of sash 10 and corresponding counterbalance systems. Sash 10, in the position shown in FIG. 1, is also moved laterally within jambs 11 to free one stile edge of sash 10 from jambs 11 for maneuvering sash 10 out from between jambs 11 or back into a position between jambs 11.

In the position shown in FIG. 2, sash 10 is centered between jambs 11 but elevated above locked shoes 30, as it is lifted off from or lowered onto shoes 30. In the position shown in FIG. 3, sash 10 is again centered between jambs 11, but is lowered onto shoes 30, which are no longer locked within jambs 11. In the supported position shown in FIG. 3, sash 10 rests on and is supported by shoes 30 by means of sash support arms 20 that are moved to an outward position. Arms 20 are in inward positions when sash 10 is lifted off of shoes 30, as shown in FIGS. 1 and 2.

Besides the preferred pivoting of sash support arms 20 on the stiles of sash 10, as illustrated in FIGS. 1–3, it is also possible to arrange sash support arms that are pivotally mounted on shoes 30. With such an arrangement, shoe mounted sash support arms would pivot inward to engage sash stiles and support the weight of a sash engaged by the arms, which are preferably braced against pivoting when in a support position. Pivoting the support arms on the shoes can thus achieve a similar result to the preferred pivoting of the support arms on the sash stiles. Either way, the support arms transfer the sash weight to the shoes and move from sash support positions when the sash is uplifted from the shoes, to allow lateral movement and withdrawal of the sash from the jambs.

More details of a preferred embodiment of a sash support system are illustrated in FIGS. 4–12. The preferred system elements include sash support arms, counterbalance shoes, and shoe-locking hooks.

Sash Support Arms

A support arm 20 is preferably pivotally mounted on each opposite stile of sash 10. Mounts for support arms 20 are preferably near lower corners of sash stiles, but more elevated mounts are also possible. As best shown in FIGS. 4, 5, 9, and 10, support arms 20 are pivotally mounted on brackets 21 of mounts 22 that are secured to the stiles of sash 10, which have a recessed edge groove that receives mount brackets 22. Pivot pins 23 support arms 20 on brackets 21 to pivot between outwardly extending positions shown in FIGS. 4, 5, and 9 and downwardly dependent positions shown in FIGS. 1, 2, and 10.

Each of these positions is limited and braced by mount block 22. In the outwardly extending position, an end 24 of arm 20 abuts against mount 22 to brace arm 20 against pivoting upward. In the downwardly dependent position, an abutment 25 on support arm 20 engages a lance 26 on mount block 22 to prevent pivoting of support arm 20 downward or inward beyond the position shown in FIG. 10.

Figure 4:
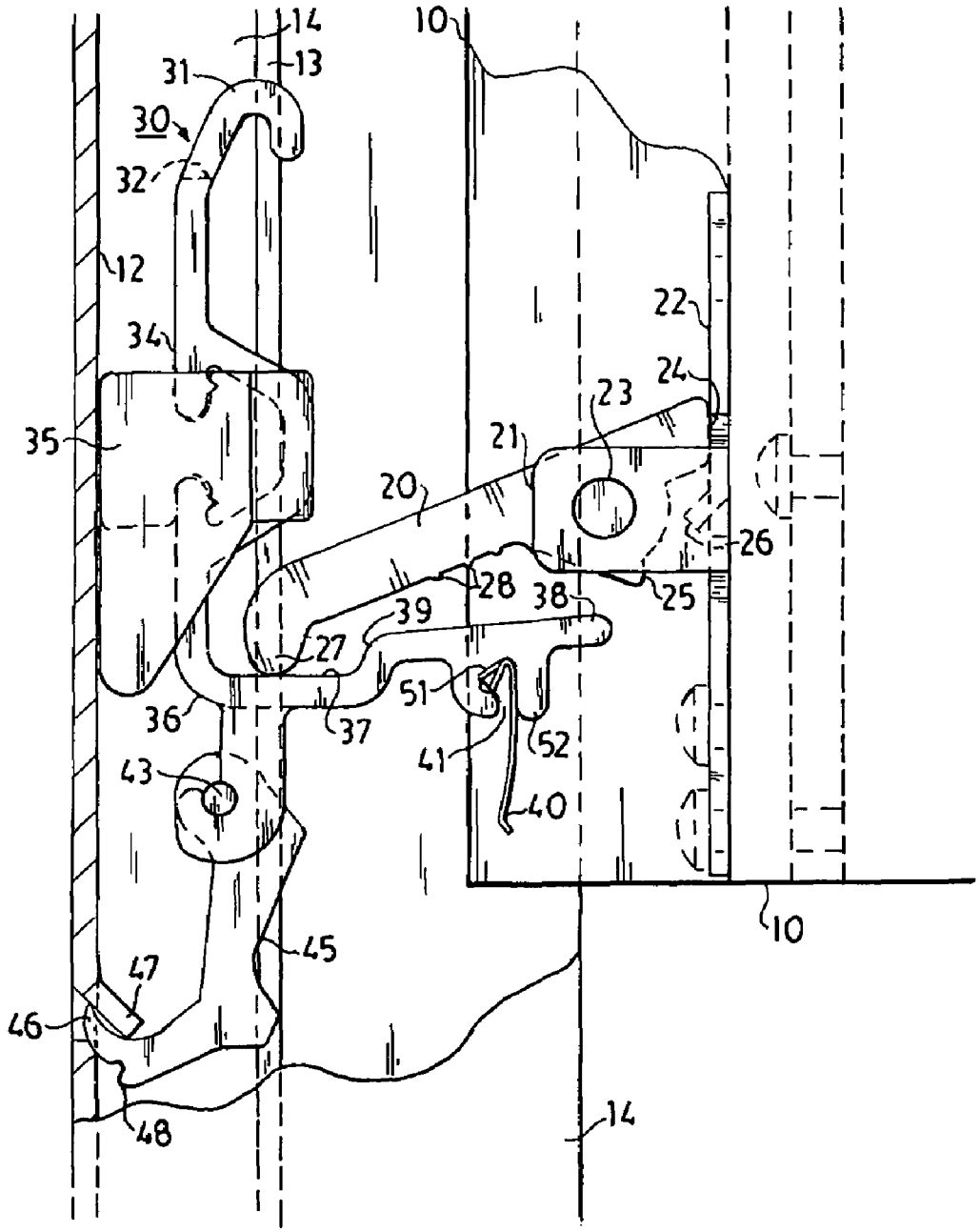
FIGS. 4 and 5 are partially cut-away elevational views showing preferred embodiments of sash support arms and counterbalance shoes, with a shoe locked in a jamb in FIG. 4 and unlocked from a jamb in FIG. 5.
Figure 5:
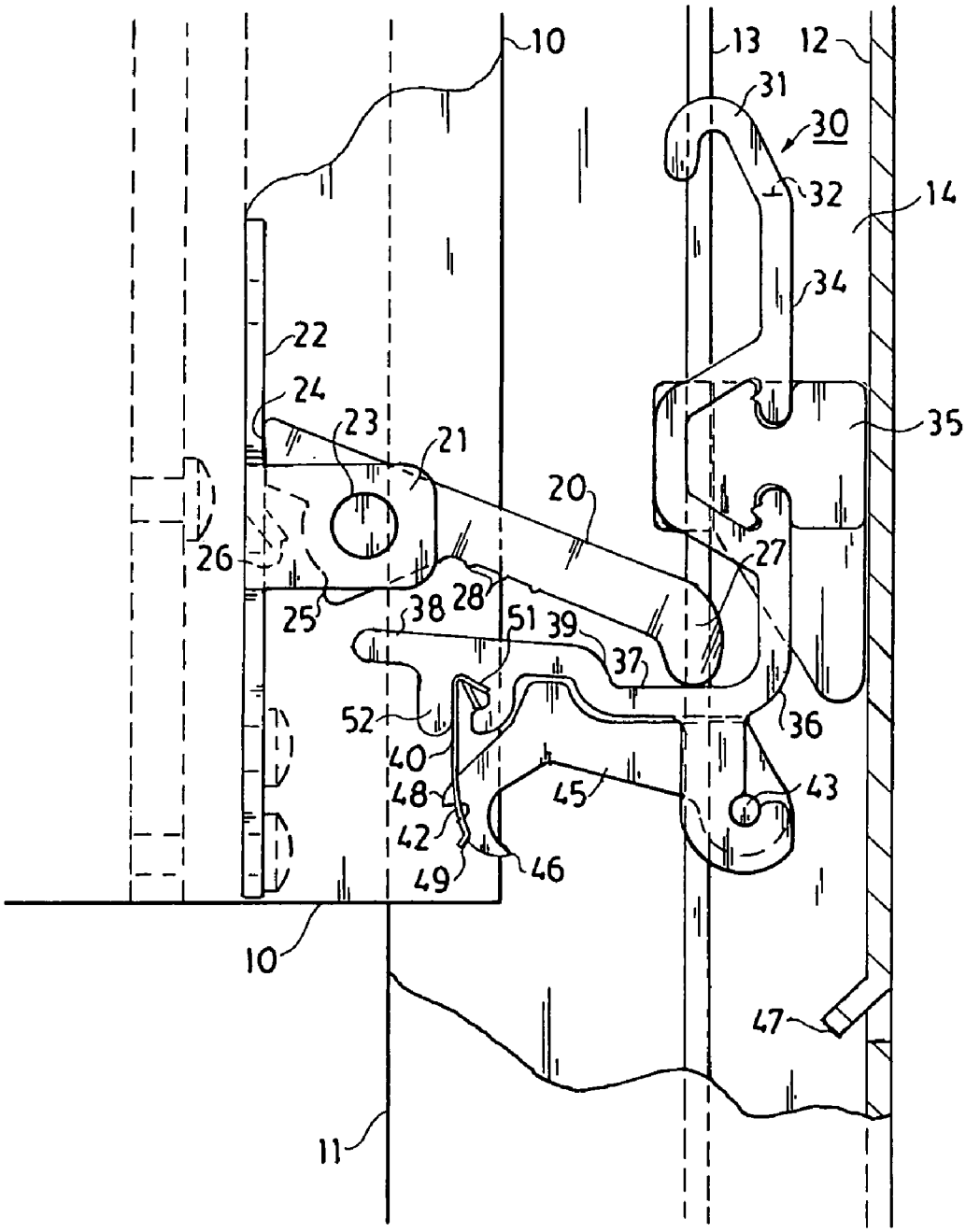
Figure 10:
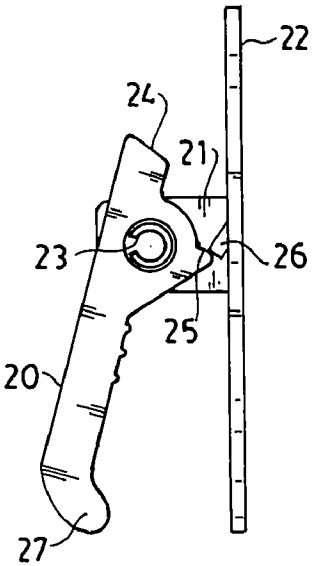
FIGS. 9 and 10 are partially cut-away views of a sash support arm shown in an outwardly extending position in FIG. 9 and in a downwardly dependent position in FIG. 10.
Figure 12:
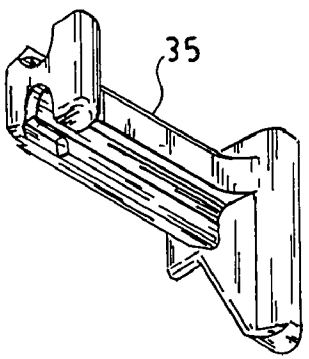
FIGS. 11 and 12 are isometric views respectively from above and below guide blocks for the shoes of FIGS. 6–8.
Figure 9:
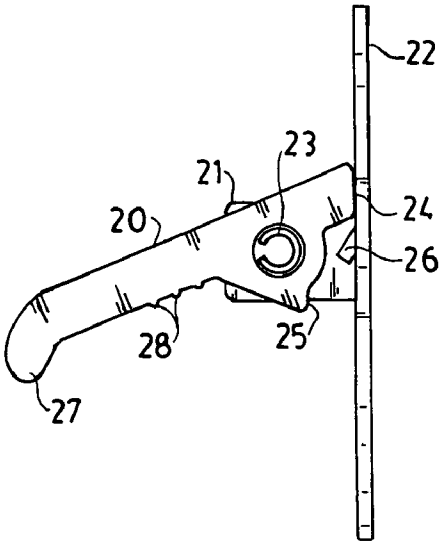
Figure 11:
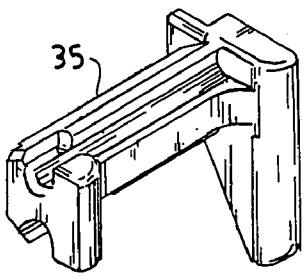

An outer end 27 of support arm 20 engages a sash shoe, as explained in more detail below. Support arms 20 having different lengths from pivot pin 23 to arm end 27 are desirable to accommodate different dimensions of window systems. Support arms 20 are also preferably formed of extruded metal, which helps make different lengths of support arms 20 inexpensive. To distinguish between support arms 20 of different lengths, the arms are preferably formed with extruded coding lines 28. For example, three coding lines 28 are illustrated in FIGS. 4 and 5 to indicate long support arms 20, and two coding lines 28 are illustrated in FIGS. 9 and 10 to indicate medium length support arms 20. Not only can different numbers of coding lines 28 be used, but these can also be positioned in different places on an extrusion from which support arms 20 are cut. Extrusion fabrication also allows support arms 20 to be cut to different widths, if necessary, to accommodate different window dimensions and sash weights.

Counterbalance Shoes

Counterbalance shoes 30 are also preferably formed of metal extrusions. Shoes 30 can then be cut to the desired shoe width from a length of extruded material having the necessary cross-sectional configuration or profile to provide the required shoe functions.

Figure 6:
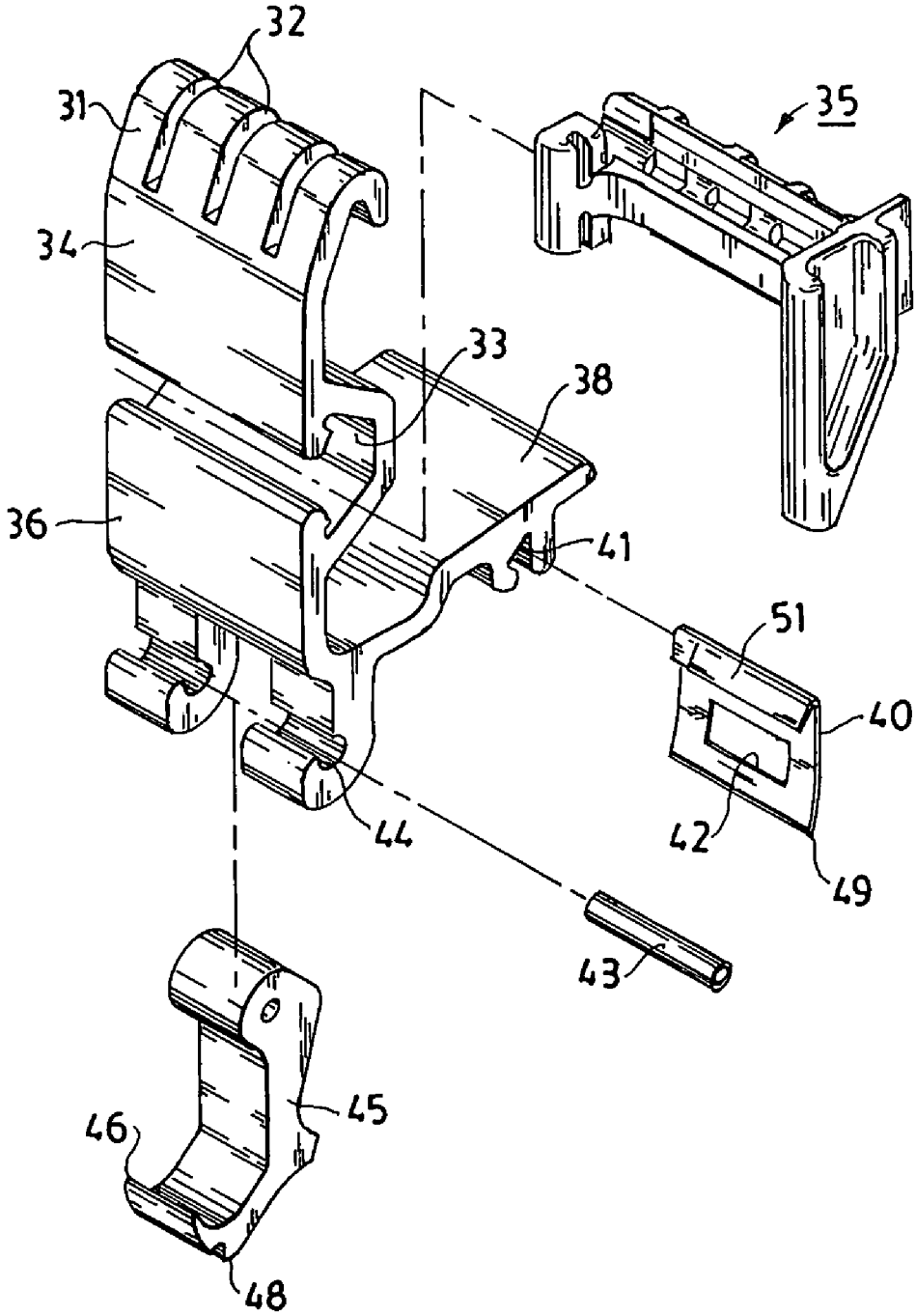
FIG. 6 is an exploded isometric rear corner view of the shoe of FIGS. 4 and 5.
Figure 8:
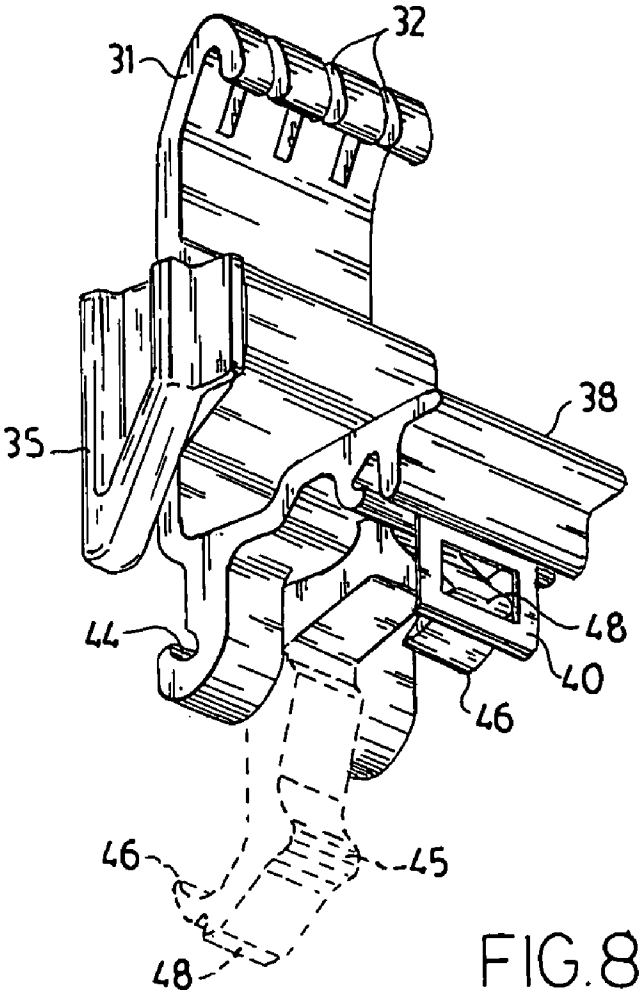
FIG. 8 is an isometric front corner view of the shoe of FIGS. 6 and 7.
Figure 7:
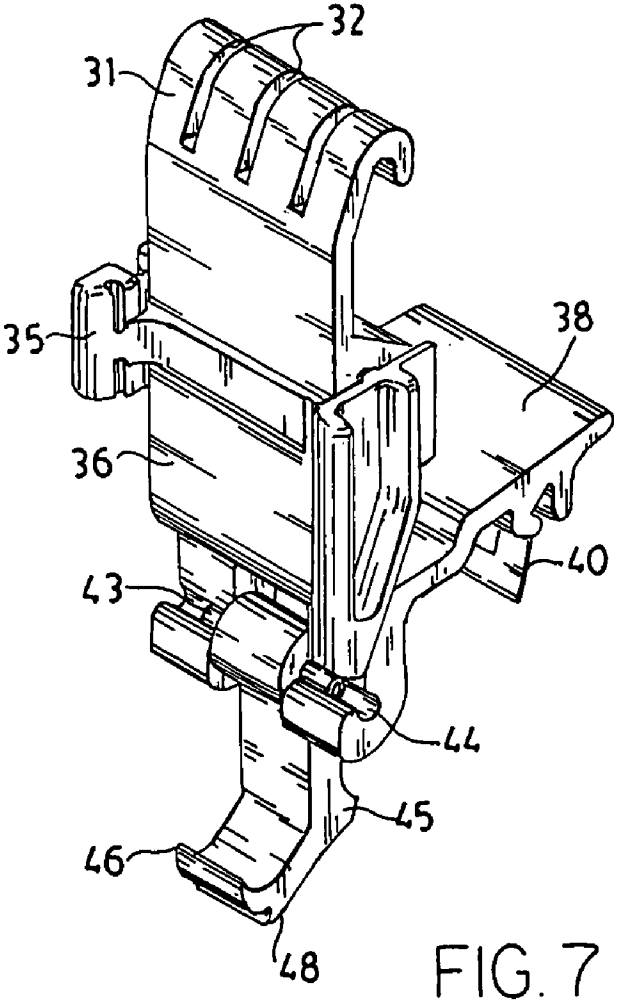
FIG. 7 is an isometric rear corner view of the shoe of FIG. 6 shown in assembled condition.

An upper region 31 of shoe 30 preferably has a hook shape in which slots 32 are cut, as shown in FIGS. 6–8, to interconnect with the lower ends of counterbalance elements that are not shown.

Shoes 30 can accommodate different numbers of counterbalance elements received in correspondingly different numbers of slots 32, especially when shoes are cut to different widths. This readily adapts a single extrusion for shoes 30 to accommodate different window dimensions and sash weights.

Preferably a mid-region 34 of shoe 30 has a groove 33 that receives and holds a guide block 35. Groove 33 and guide block 35 are shaped so that block 35 can be slid endwise into groove 33 where it is frictionally held in place. Block 35 is preferably molded of resin material and configured to bear against a rear wall 12 of jamb 11 and against fins 13 that extend inward in jamb 11. Guide block 35 gives shoe 30 a smooth running fit within a channel 14 formed behind fins 13 in a rear region of jamb 11 spaced outward from sash 10. Channel 14 then serves as a vertical run for block 35 which in turn guides shoe 30 vertically within jamb 11, while holding shoe 30 away from any metal-to-metal contact with jamb 11. Guide block 35 can have many configurations that perform the necessary guiding function, which includes both vertical guidance and resistance to torsion applied to shoe 30 by counterbalance elements to which it is connected.

A lower region 36 of shoe 30 has a sash support platform 37 that is engaged by the ends 27 of sash support arms 20 to uphold the weight of sash 10. Platforms 37 extend toward sash 10 far enough to engage sash support arms 20 in their inward positions illustrated in FIG. 10. The extension of platforms 37 towards sash 10 also leaves free room above platforms 37 for sash 10 to be moved laterally while it is raised above platforms 37 and maneuvered out of or into the space between opposed jambs 11.

As a sash 10 is lowered into a supported position on shoes 30, the ends 27 of support arms 20 first engage inner end regions 38 of support platforms 37; and then as sash 10 is further lowered, arm ends 27 slide outward along platforms 37 to the support position illustrated in FIGS. 4 and 5. The reverse occurs as sash 10 is lifted up off of shoes 30.

The small step 39 in platform 37 is preferred for resisting lateral movement of sash 10 while resting on shoes 30 and as a positive indication that arm ends 27 of a sash being lowered have reached appropriately supported positions on platforms 37. The regions where arm ends 27 support sash 10 on platforms 37 are preferably directly below slots 32 where counterbalance elements exert an upward force on upper regions 31 of shoes 30. This minimizes any moment arms tending to turn shoes 30 around horizontal axes.

Shoe-Locking Hooks

Below platform 37 is preferably arranged a groove 44 that receives a pivot pin 43 for a shoe-locking hook 45. Pin 43 can be pressed axially into groove 44 and through hook 45 to leave hook 45 pivotally hanging below platform 37, as illustrated in FIGS. 4, 7, and 8. The center of gravity of hook 45 is arranged toward the sash side of pivot pin 43 so that the end 46 of hook 45 bears against the rear wall 12 of jamb 11. There, hook end 46 interlocks with a projection or lance 47 formed in jamb wall 12, as illustrated in FIG. 4.

The underside of the inward region 38 of support platform 37 preferably has a groove 41 that receives and retains a resilient latch spring 40. An anchored end 51 of spring 40 can be pressed into slot 41 to retain spring 40 frictionally in place. A downwardly extending projection 52 engages spring 40 to prevent movement beyond a resilient latching position, as illustrated.

Hook 45 has a latching nose 48 that latches into an opening 42 in spring 40, as illustrated in FIG. 5. Latching nose 48 and spring 40 are preferably configured so that shoe-locking hook 45 can be manually pushed into the latched position shown in FIG. 5. Unlatching shoe lock 45 for deployment preferably requires pressing a screwdriver blade in between hook end 46 and the free end 49 of spring 40. This makes the accidental deployment of shoe locks 45 unlikely.

Shoe lock 45 is also preferably cut from an indefinite length of a metal extrusion. This can give hook 45 the necessary strength to resist the counterbalance bias, while also keeping hook 45 inexpensive. Although lances 47 are preferred for their simplicity and effectiveness in interacting with locks 45, other projections or interlock discontinuities in jamb 11 are also possible.

When the elements of the inventive sash support system are assembled and operated, as shown schematically in FIGS. 1–3, they meet all the objectives of the invention. They reduce the cost of a sash support system while improving its convenience, effectiveness, and reliability. They also allow a window sash to be easily raised or lowered by a person who may weigh less than the sash.

We claim:

1. A system supporting a sash that is laterally removable from between opposed window jambs, the system comprising:

a. a pair of sash support arms mounted to hang freely downward on respective opposite stiles of the sash and to pivot from downwardly hanging positions to outwardly extended positions that the support arms assume when supporting the sash;

b. the sash support arms in the downwardly hanging positions being disposed so that as the sash is lowered toward a supported position, the downwardly hanging arms engage sash supporting platforms of counterbalanced sash shoes locked into the jambs so that sash-lowering engagement between the arms and the platforms pivots the arms outward along the platforms; and c. outer end regions of the sash support arms in the outwardly extended positions rest on outer regions of the platforms spaced from the sash and arranged vertically under counterbalance elements connected to the shoes to support the weight of the sash.

2. The system of claim 1 wherein the sash supporting platforms of the shoes extend toward the sash stiles so that inner regions of the platforms engage the sash support arms in the downwardly hanging positions and so that the outer regions of the platforms engage the outer end regions of the sash support arms in the outwardly extended positions.

3. The system of claim 2 wherein the counterbalance elements are connected to the shoes vertically above the outer platform regions.

4. The system of claim 1 wherein the shoes include locking elements deployable to lock the shoes to jamb projections during removal and replacement of the sash.

5. The system of claim 4 wherein the locking elements are pivotally mounted on the shoes and are adapted to be latched in undeployed positions out of engagement with the jamb projections.

6. The system of claim 4 wherein the locking elements are formed as extruded metal hooks.

7. The system of claim 1 wherein the shoes and the sash support arms are each formed by metal extrusion.

8. The system of claim 7 wherein the shoes can be formed with different widths.

9. The system of claim 8 wherein each shoe having one of the different widths is adapted to connect to a corresponding number of the counterbalance elements.

10. The system of claim 7 wherein the extrusion for the sash support arms can be formed in different lengths.

11. The system of claim 10 wherein the sash support arms have extruded code lines indicating a size thereof.

12. In a system counterbalancing a window sash supported by a pair of counterbalanced sash shoes so that the sash extends between a pair of jambs from which the sash is removable by maneuvering the sash upward and laterally while the shoes are locked to the jambs, the improvement comprising:

a. the shoes including locking elements comprising hooks that catch on and engage jamb projections, to lock the shoes with respect to the jamb during sash removal and including replacement and latches that latch the locking elements in undeployed positions out of engagement with the jamb projections and the shoes being formed from a metal extrusion having a predetermined profile; and b. each shoe comprising a single piece having a hook-shaped upper region formed to interconnect with a counterbalance element and an L-shaped lower region forming a platform extending toward the sash from vertically below the upper region.

13. In a system counterbalancing a window sash supported by a pair of counterbalanced sash shoes so that the sash extends between a pair of jambs from which the sash is removable by maneuvering the sash upward and laterally while the shoes are locked to the jambs, the improvement comprising:

a. the shoes being formed from a metal extrusion having a predetermined profile and including latch retaining grooves for receiving hook latches and pin grooves for receiving pivot pins of the hook latches and each shoe includes a mid-region being formed to support a guide that slides in a respective one of the jambs to guide vertical movement of the shoe and includes a guide retaining groove for receiving the guide; and b. each shoe comprising a single piece having a hook-shaped upper region formed to interconnect with a counterbalance element and an L-shaped lower region forming a platform extending toward the sash from vertically below the upper region.

14. A sash support system comprising:

a. a plurality from sash support elements each formed of a metal extrusion having a profile establishing a respective configuration of each element;

b. the configuration of a first one of the extruded elements forming a shoe extending in a single extruded piece from a hook-shaped upper region engaging a counterbalance to a platform-shaped lower region supporting a sash; and c. the configuration of a second one of the extruded elements forming a sash support arm pivotally connected to a stile of the sash to engage the platform-shaped lower region of the shoe when the sash support arm is in an outwardly extending position extending outwardly of the sash and to drop to a downwardly dependent position when the sash support arm does not engage the platform shaped lower region.

15. The system of claim 14 wherein the configuration of a third one of the extruded elements forms a shoe lock connected to the shoe below the platform shaped lower region to be movable between deployed and undeployed positions.

16. The system of claim 15 wherein the shoe pr-file includes a pin groove for receiving a pivot pin supporting the shoe lock.

17. The system of claim 15 including a resilient latch mounted on the shoe for retaining the shoe lock in the undeployed position.

18. The system of claim 17 wherein the shoe lock and the latch are configured so that the shoe lock is manually latchable and unlatchable.

19. The system of claim 15 wherein the shoe lock is pivotally movable between the deployed and undeployed positions and is downwardly dependent from the shoe in the deployed position.

20. The system of claim 14 wherein the second one of the extruded elements can be formed with different profiles establishing different lengths for the support arm.

21. The system of claim 20 wherein the second one of the extruded elements is formed with code lines indicating the length of the arm.

22. The system of claim 14 including a resin guide mounted on the shoe.

23. The system of claim 22 wherein of a mid-region of the shoe is formed with a locking slot for receiving the resin guide.

24. The system of claim 14 wherein the sash support aim is pivotally mounted on the sash stile to move to the outwardly extending position to support the sash upon engagement with the platform shaped lower region and to move to the downwardly dependent position upon disengagement with the platform shaped lower region.

25. The system of claim 24 wherein the sash support arm braces against a mounting bracket limiting movement of the sash support arm beyond the outwardly extending and downwardly dependent positions.

26. The system of claim 14 wherein the shoe can be formed with different widths established by different predetermined lengths of the first extruded element.

27. The system of claim 26 wherein each width of the shoe is connectable to a respective number of counterbalance elements.

28. A sash support comprising:

a. sash support arms movably mounted respectively on each stile of a sash so that the support arms hang downward in dependent positions when not supporting the sash and move outward to braced positions in response to engagement of the support arms with locked sash shoes as the sash is lowered between the shoes so that the weight of the lowered sash urges the sash support arms outward on the shoes to the braced positions; and b. the support arms in the braced positions having end regions resting on the sash shoes in sash support regions of the shoes vertically under counterbalance regions of the shoes where counterbalance elements connect to the shoes to minimize moment arms tending to turn the shoes around horizontal axes.

29. The support of claim 28 wherein mounting brackets pivotally mount the support arms on the sash stiles and limit movement of the support arms beyond the dependent and braced positions.

30. The support of claim 28 wherein the sash support arms are formed from a metal extrusion.

31. The support of claim 30 wherein the extrusion can be formed with different profiles each establishing a different arm length with extruded coding lines indicating the support arm length.

32. The support of claim 28 wherein the shoes are formed from a metal extrusion.

33. A sash support comprising:

a. sash support arms movably mounted respectively on each stile of a sash so that the support arms hang downward in dependent positions when not supporting the sash and move outward to braced positions in response to engagement of the support arms with locked sash shoes as the sash is lowered between the shoes so that the weight of the lowered sash urges the sash support arms outward on the shoes to the braced positions; and b. the support arms in the braced positions having end regions resting on the sash shoes in sash support regions of the shoes vertically under counterbalance regions of the shoes where counterbalance elements connect to the shoes to minimize moment arms tending to turn the shoes around horizontal axes, wherein the shoes are formed from a metal extrusion that forms the counterbalance regions vertically above the sash support regions that are engaged by the end regions of the support arms in their braced positions.

34. The support of claim 33 wherein the support regions of the shoes extend toward the sash stiles to engage the support arms in their dependent positions when the sash is lowered into engagement with the shoes.

35. The support of claim 34 wherein the support arms move from their dependent positions to their outward braced positions by sliding along the support regions of the shoes as the sash is lowered.

36. A system locking counterbalance shoes to window jambs while a sash supported on the shoes is removed from between the window jambs, the system comprising:

a. the shoes having hooks that are pivotally mounted on the shoes below sash supporting platforms of the shoes so that the hooks can move between latched and unlatched positions while the sash is supported on the platforms;

b. the hooks in the unlatched positions hanging dependently downward from the shoes below the sash supporting platforms where the hooks are disposed to hook under lances formed in the jambs as the shoes rise;

c. the hooks in the latched positions being retained out of engagement with the jambs and clear of the lances; and d. resilient latches are carried on the shoes for holding the hooks in the latched positions.

37. The system of claim 36 wherein the hooks are manually movable into the latched positions and are released from the latched positions by pressing between ends of the hooks and the latches.

38. A system locking counterbalance shoes to window jambs while a sash supported on the shoes is removed from between the window jambs, the system comprising:

a. the shoes being formed from a metal extrusion and having hooks also formed from a metal extrusion with the hooks pivotally mounted on the shoes below sash supporting platforms of the shoes so that the hooks can move between latched and unlatched positions while the sash is supported on the platforms, the shoes having grooves that receive pivot pins supporting the hooks, and slots that retain resilient latches for holding the hooks in the latched positions;

b. the hooks in the unlatched positions hanging dependently downward from the shoes below the sash supporting platforms where the hooks are disposed to hook under lances formed in the jambs as the shoes rise; and c. the hooks in the latched positions being retained out of engagement with the jambs and clear of the lances.

39. A system supporting a sash that is laterally removable from between opposed window jambs and is supported on counterbalanced shoes that run vertically within the jambs and are separated sufficiently to allow lateral movement of the sash, the system comprising:

a. the shoes having platforms that extend toward the sash to support the sash;

b. the sash having a pair of stiles and a pair of support arms connected respectively to the stiles so that the sash support arms rest in downwardly hanging positions in which lower ends of the support arms engage sash end regions of the shoe platforms when the sash and the support arms are moved downward from above the shoe platforms;

c. the sash support arms being mounted on the sash to pivot from the downwardly hanging positions to outwardly extending positions in which the sash support arms engage jamb end regions of the shoe platforms as the weight of the downwardly moved sash transfers to the shoes via the support arms; and d. counterbalance elements exerting a lifting force on the shoes in regions vertically above the jamb end regions of the shoe platforms.

40. The system of claim 39 wherein the shoes are formed from a metal extrusion.

41. The system of claim 39 wherein the shoe platforms are configured with steps that the ends of the support arms slide downward over as the support arms move from the sash end regions to the jamb end regions of the shoe platforms.

42. The system of claim 39 wherein the sash support arms are braced against movement beyond the downwardly hanging positions and the outwardly extending positions.

43. The system of claim 39 wherein the sash support arms are formed from a metal extrusion.

44. The system of claim 43 wherein the extrusion can be formed with different profiles to form support arms of different lengths.

45. The system of claim 44 wherein the extrusion is formed with coding lines to indicate the length of the sash support arms.

* * * * *

UNITED STATES PATENT AND TRADEMARK OFFICE

CERTIFICATE OF CORRECTION

PATENT NO. : 6,948,279 B1
DATED : September 27, 2005
INVENTOR(S) : Newton et al.

It is certified that error appears in the above-identified patent and that said Letters Patent is hereby corrected as shown below:

Column 6,
Line 50, replace “from sash support elements each formed of” with -- of sash suport elements each formed from --.

Column 7,
Line 4, replace “shoe pr-file” with -- shoe --.
Line 26, replace “wherein of” with -- wherein --.
Line 29, replace “aim” with -- arm --.

Signed and Sealed this

Sixth Day of December, 2005

JON W. DUDAS
*Director of the United States Patent and Trademark Office*